United States Patent [19]

Ferguson

[11] Patent Number: 4,691,452

[45] Date of Patent: Sep. 8, 1987

[54] ARTICULABLE SIPHON TUBE ASSEMBLY FOR DRYER DRUM

[75] Inventor: George R. Ferguson, Clover, S.C.

[73] Assignee: Duff Norton Company, Charlotte, N.C.

[21] Appl. No.: 887,888

[22] Filed: Jul. 18, 1986

[51] Int. Cl.[4] ..... F26B 25/20

[52] U.S. Cl. ..... 34/119; 34/124; 34/125

[58] Field of Search ..... 34/119, 124, 125; 165/89, 90

[56] References Cited

U.S. PATENT DOCUMENTS

| | | | |
|---|---|---|---|
| 267,666 | 11/1882 | Brigham . | |
| 1,664,656 | 4/1928 | Berry . | |
| 1,665,614 | 4/1928 | Valentine . | |
| 1,715,677 | 6/1929 | Ritchie . | |
| 1,948,963 | 2/1934 | Dukes . | |
| 1,991,432 | 2/1935 | Valentine et al. . | |
| 2,045,634 | 6/1936 | Cram . | |
| 2,116,004 | 5/1938 | Tear . | |
| 2,166,245 | 7/1939 | Goff et al. . | |
| 2,299,530 | 10/1942 | Cram et al. . | |
| 2,351,733 | 6/1944 | Armstrong . | |
| 2,423,069 | 6/1947 | McElhose et al. . | |
| 2,437,004 | 3/1948 | Rutledge . | |
| 2,447,947 | 8/1948 | Larson et al. . | |
| 2,460,059 | 1/1949 | Bruker . | |
| 2,472,425 | 6/1949 | Howard . | |
| 2,617,205 | 11/1952 | Cram . | |
| 2,783,977 | 3/1957 | Seanor . | |
| 2,873,538 | 2/1959 | Shumaker . | |
| 2,875,527 | 3/1959 | Daane . | |
| 2,911,234 | 11/1959 | Hieronymus . | |
| 2,934,831 | 5/1960 | Tasker | 34/125 |
| 2,978,815 | 4/1961 | Hieronymus . | |
| 3,034,225 | 5/1962 | Hieronymus . | |
| 3,242,583 | 3/1966 | Calkins . | |
| 3,265,411 | 8/1966 | Monroe et al. . | |
| 3,449,839 | 6/1969 | Crist . | |
| 3,473,237 | 10/1969 | McCourt . | |
| 3,473,238 | 10/1969 | Talley et al. . | |
| 3,606,394 | 9/1971 | Maurer . | |
| 3,640,000 | 2/1972 | Lee et al. . | |
| 3,808,700 | 5/1974 | Kraus . | |
| 3,943,638 | 3/1976 | Robson . | |
| 3,948,283 | 4/1976 | Asfura et al. . | |
| 4,051,604 | 10/1977 | Feissner . | |
| 4,232,455 | 11/1980 | Burton . | |
| 4,266,730 | 5/1981 | Grohe . | |
| 4,402,234 | 9/1983 | Malarz et al. . | |
| 4,436,326 | 3/1984 | Peaster . | |
| 4,476,637 | 10/1984 | Justus et al. . | |
| 4,477,107 | 10/1984 | Ferguson et al. . | |

FOREIGN PATENT DOCUMENTS

| | | | |
|---|---|---|---|
| 752565 | 7/1956 | United Kingdom | 34/125 |

*Primary Examiner*—Larry I. Schwartz

*Attorney, Agent, or Firm*—Shefte, Pinckney & Sawyer

[57] ABSTRACT

A siphon tube assembly for papermaking dryer drums having a threaded rotary elbow connection between support and siphon tubes permitting the tubes to be selectively oriented by rotation of the elbow connection between an installation position wherein the tubes are in general alignment and an operative position wherein the tubes are angularly related. In a preferred embodiment, the siphon tube is braced in rigid engagement with the interior of the dryer drum for use as a rotating siphon, it being also contemplated that the present elbow joint may be embodied in stationary siphons. The elbow joint provides an operating keyway accessible through the interior of the support tube for manipulating rotation of the elbow joint without requiring the use of handholes or manholes in the dryer durm.

17 Claims, 7 Drawing Figures

ARTICULABLE SIPHON TUBE ASSEMBLY FOR DRYER DRUM

BACKGROUND OF THE INVENTION

In a traditional paper manufacturing process, a paper web once formed is directed in peripheral contact about one or more heated rotating drums to effectively dry the paper web. A dryer drum of this conventional type basically includes a hollow cylindrical shell substantially enclosed by opposite end heads each of which includes a central trunnion or other appropriate journal coaxial with the shell for rotatably mounting it. The cylindrical shell usually has a smooth outer peripheral surface for carrying the paper web, with the drum being interiorly steam heated to transfer drying heat through the shell to the traveling paper web. Conventionally, an axial conduit system is arranged centrally through one of the trunnions to continuously supply steam to the interior of the dryer drum while simultaneously withdrawing therefrom the water of condensation naturally resulting from the drying process.

As will be understood, the efficiency and rapidity of the web drying process is dependent directly upon the amount of heat transferred by the cylindrical shell from the drum interior to the traveling paper web. In turn, the degree of heat transfer from the steam contained within the interior of the dryer drum is dependent to a large extent upon the efficient withdrawal of the water of condensation from the drum interior. As concern has grown in recent years for greater efficiency and economy in papermaking operations, the speed of operation of papermaking machines and, in turn, of their associated dryer drums, has been significantly increased. As a result, the need for efficient condensate removal has become even more important. Particularly, in the high speed operation of dryer drums, a tendency exists for the water of condensation to form under the effect of centrifugal force as a thin sheet or film substantially entirely about the interior periphery of the cylindrical shell, this so-called "rimming" of the condensate serving to significantly inhibit the complete transfer of steam heat to the traveling paper web.

One ongoing and yet unsolved problem in the design of dryer drums resides in the accommodation for easy installation of a journal-supported conduit system of the aforementioned type. While the location of steam admission to the interior of the dryer drum is not critical to achieve sufficient heating of the drum, it is very important that the conduit arrangement for withdrawing the water of condensation have a pick-up end disposed as closely as possible to the interior peripheral wall of the cylindrical shell of the drum in order to efficiently remove condensate with minimal "rimming" about the shell interior. Over the years, two basic types of suction arrangements, commonly referred to as "siphons," have evolved. In so-called "stationary" siphons, a siphon tube assembly extends axially through the end trunnion of the dryer drum to the interior thereof and then angularly downwardly to a close spacing with the interior wall surface of the peripheral shell at its lowermost point, in which disposition the siphon tube assembly remains stationary during operation of the dryer drum to withdraw condensing water which collects under the force of gravity in the bottom of the drum over the course of its operation. In so-called "rotating" siphons, a siphon tube assembly similarly extends axially through the end journal of the dryer drum and angularly therefrom within the drum interior, the siphon tube assembly being fixed to the trunnion of the dryer drum with the interior end of the siphon tube assembly being fixed to the interior wall surface of the cylindrical shell of the drum for unitary rotation therewith during its operation.

Stationary siphons provide effective condensate removal in dryer drums operating at relatively low speeds. However, the interior suction end of a stationary siphon tube assembly must remain at a sufficient spacing from the interior wall of the cylindrical shell of the drum in order to avoid wearing contact therewith, whereby such siphons are essentially ineffective in high speed dryer drums for preventing undesired "rimming" of the water of condensation about the cylindrical shell of the drum. Rotating siphons provide considerably more effective condensate removal since a closer spacing may be utilized between the interior end of the siphon tube assembly and the cylindrical shell, but such siphons are more difficult and time consuming to install in a dryer drum because of the need to affix the interior end of the siphon tube assembly to the cylindrical shell.

For both stationary and rotating-type siphon tube assemblies, installation in a dryer drum is normally performed by assembling the components of the siphon within the drum interior through removable "handholes" or "manholes" provided in the end head of the drum. As will be recognized, this process is tedious and time consuming, particularly in that it requires that the dryer drum be cooled to a suitable temperature permitting workmen to operate within the drum interior. Various forms of siphon tube assemblies having some form of pivoting intermediate joint have been proposed to facilitate insertion of the tube assembly in a generally linear disposition through the axial trunnion of a dryer drum with subsequent pivoting of the tube assembly into an operative siphoning disposition once the pivot joint is positioned within the drum interior. Representative examples of such siphon tube assemblies are disclosed in U.S. Pat. Nos. 2,299,530; 2,617,205; 2,875,527; and 2,978,815. Pivoted siphon tube assemblies of this type advantageously simplify the installation process and are readily adapted for use in dryer drums having no handholes or manholes. However, while such siphon tube assemblies provide effective operating results when used as stationary siphons, the forms of such siphons designed for rotating-type uses have generally been found to be unacceptable for failure to provide an adequately rigid engagement of the interior suction end of the siphon tube assembly with the interior peripheral wall of the dryer drum, which may result in either or both ineffective condensate removal and possibly damaging wear to the interior of the cylindrical shell.

It is accordingly an object of the present invention to provide an articulable siphon tube assembly easily adapted for use in paper drying drums for selective articulation for insertion into and removal from the drum through its axial journal and for siphoning disposition within the drum at a peripheral drying wall thereof, all without requiring the use of any handholes or manholes in the drum. A more specific object of the present invention is the provision of an articulable siphon tube assembly particularly adapted for selective articulation within the dryer drum into rigid braced siphoning engagement with the peripheral drying wall of the drum for operation as a rotary-type siphon, while also being adapted for use in stationary-type siphon embodiments.

SUMMARY OF THE INVENTION

Briefly described, the siphon tube assembly of the present invention includes a support tube member adapted for operative positioning within the axial opening of the journal for the dryer drum, a siphon tube member for operative positioning within the drum in siphoning disposition at the peripheral wall thereof, and a tubular elbow member disposed intermediate and connected with the support tube and siphon tube members in respective end-to-end communication. According to the present invention, the elbow member is rotatably connected with respect to one of the support and siphon tube members about an axis angularly oriented with respect to both thereof and the elbow member is fixed to the other of the support and siphon tube members. In this manner, the elbow member and the other tube member to which it is fixed may be selectively rotated as a unit to orient the support and siphon tube members either in general alignment with one another for permitting insertion and removal of the siphon tube assembly through the axial opening in the journal or at sufficient angular relation to one another for permitting mounting of the support tube member coaxially within the axial opening of the journal with the siphon tube member disposed at the peripheral drum wall for siphoning operation of the siphon tube assembly within the drum.

It is contemplated that the siphon tube assembly of the present invention may be embodied in either a rotary-type siphon or a stationary-type siphon. For rotary siphoning use, the elbow member and the siphon tube member are cooperatively arranged for disposition of the siphon tube member braced rigidly in engagement with the peripheral drum wall in the angular relation of the support tube member and the siphon tube member for rotation of the siphon tube assembly unitarily with the drum. The rotational connection between the elbow member and the one tube member preferably is provided by mating respective threads thereon which are of a hand counter to the direction of rotation of the dryer drum to resist relative rotation between the threads and to maintain the siphon tube member in braced engagement with the drum during its rotational operation. As a stationary siphon, the elbow member and the support tube member are cooperatively arranged for disposition of the siphon tube member at a spacing from the peripheral drum wall in the angular relation of the support tube member and the siphon tube member for stationary disposition of the siphon tube assembly during rotation of the drum.

In the preferred embodiment of the present siphon tube assembly, the elbow member is fixed rigidly to the siphon tube member and is rotably connected to the support tube member, the elbow member including an interior keyway facing the interior of the support tube member for access therethrough to the keyway for permitting unitary rotation of the elbow and siphon tube members to control the articulation of the support tube assembly from the exterior of the drum without the use of or need for handholes or manholes. Preferably, the support tube member has a nut member rigidly fixed to the elbow connection end thereof about an axis angularly related to the axis of the support tube member. The elbow member includes a first connection end for rotational connection with the nut member, and a second connection end for fixed connection rigidly with the siphon tube member with its axis angularly related to the rotational axis of the nut and elbow members. An angled bore is formed through the elbow member between its connection ends, the bore at the first connection end being angularly related with the rotational axis between such end and the nut member to be oriented coaxially with the support tube member in its angular relation with the siphon tube member.

The support tube member, its nut member, the elbow member and the siphon tube member are cooperatively configured and dimensioned in the preferred embodiment such that the support tube assembly in its generally aligned disposition is of an overall transverse, or diametric, dimension less than the transverse dimension of the axial opening through the journal along any increment of the length of the support tube assembly to be inserted through said axial opening which is equal to or less than the length of the axial opening. More particularly, the journal-inserted portion of the support tube member and the elbow member are of a combined overall dimension transversely with respect to the length of the support tube member less than the transverse dimension of the axial opening through the journal. The siphon tube member includes a suction foot mounted at its extending end angularly with respect to the length thereof such that the siphon tube member in its generally aligned disposition with the support tube member has an overall dimension transversely with respect to the length of the support tube member less than the transverse dimension of the axial opening.

DESCRIPTION OF THE PREFERRED EMBODIMENT

Referring now to the accompanying drawings, the present invention will be described more fully hereinafter with reference to a preferred embodiment of the present invention illustrated therein. However, it is to be understood that the following description is intended only as a broad, teaching disclosure directed to persons of skill in the appropriate arts, and not as limiting upon the present invention. Persons of skill in the appropriate arts will recognize that the present invention herein described may be modified or adapted in other embodiments while still achieving the favorable results of the present invention and without departing from the substance and scope thereof.

Figure 1:
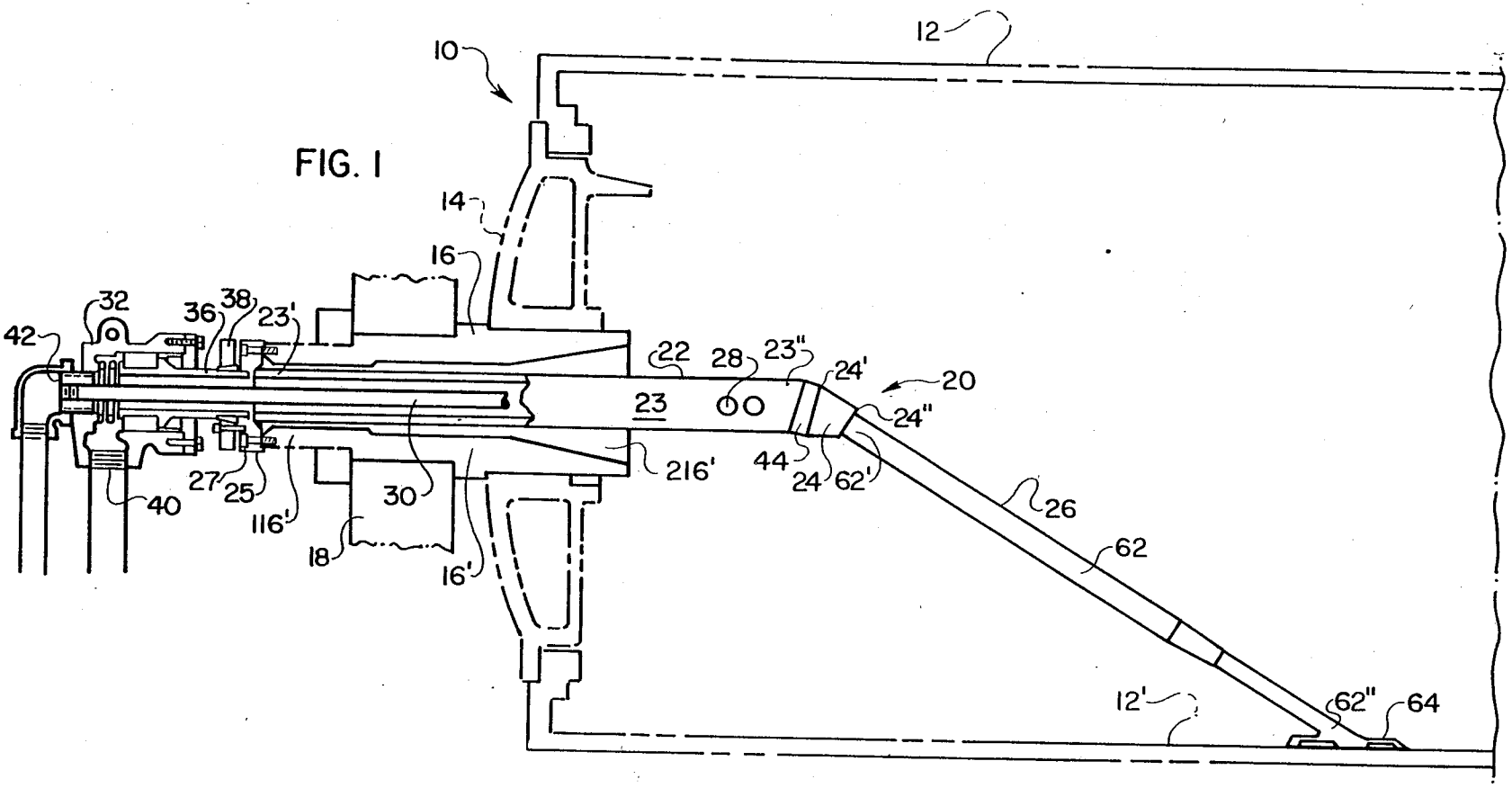
FIG. 1 is a view partly in side elevation and partly in vertical cross-section showing the preferred embodiment of the articulable siphon tube assembly of the present invention installed in a rotary papermaking dryer drum for operation as a rotary siphon.

With reference first to FIG. 1, a dryer drum apparatus of the heretofore-described type adapted for continuously drying a traveling paper web in a papermaking operation is generally indicated at 10. Only one end portion of the dryer drum apparatus 10 is shown in FIG. 1 for succinctness of illustration, it being understood by those persons skilled in the appropriate arts that the dryer drum apparatus 10 is of an essentially mirror-image construction at its opposite end. The dryer drum apparatus 10 is of an essentially conventional construction including a thin-walled hollow cylindrical shell 12 the opposite ends of which are substantially enclosed by a pair of circular end heads 14. Each end head 14 has a circular opening therethrough at its center coaxial with the cylindrical shell 12 in which opening is affixed a tubular support trunnion or other suitable journal 16. The body of each support trunnion 16 extends axially outwardly from its respective end head 14, the trunnions 16 being respectively supported rotatably in a pair of suitable bearings, representatively indicated at 18, to permit rotational operation of the dryer drum apparatus 10. Each support trunnion 16 has a circular opening 16′ extending axially centrally through its entire length, the opening 16′ being of a stepped increasing diameter from an axially outward entrance end 116′ of reduced diameter to an axially inward tapered end 216′ of increasing diameter.

The siphon tube assembly of the present invention is indicated generally at 20 in FIG. 1 mounted within the axial opening 16′ through one of the tubular trunnions 16 and extending angularly within the hollow interior of the dryer drum apparatus 10 into rigidly braced siphoning engagement with the interior peripheral drying wall 12′ of the dryer shell 12 for operation as a rotary siphon. The siphon tube assembly 20 basically includes a support tube member 22 affixed to the trunnion 16 to extend coaxially therethrough to the interior of the dryer drum apparatus 10, a tubular elbow member 24 rotatably attached angularly to the inwardly projecting end of the support tube member 22 in end-to-end communication therewith, and a siphon tube member 26 rigidly affixed to the elbow member 24 in end-to-end communication therewith and extending therefrom angularly into braced siphoning engagement with the interior cylinder wall 12′. The support tube member 22 includes a main tubular support conduit 23 to one end 23′ of which is welded a mounting flange 25 for bolting at 27 in fixed abutment with the outward end face of the trunnion 16. The opposite inwardly projecting end 23″ of the support tube 23 has a plurality of holes 28 formed through its periphery to establish communication between the interior of the support tube member 22 and the hollow interior of the dryer drum apparatus 10, while a siphon pipe 30 extends coaxially through the center of the support tube member 22 and is fitted interiorly within the elbow member 24 to establish siphoning communication between the pipe 30, the elbow 24 and the siphon tube 26 while closing the elbow member 24 and the siphon tube 26 from communication with the support tube member 22.

A conventional rotary joint assembly 32 is mounted to the exterior of the trunnion 16 in communication with the interior of the support tube member 22 and with the siphon pipe 30 for establishing steam supply and condensate return fluid flow connections respectively therewith in a conventional manner. It will be understood by those persons skilled in the appropriate arts that substantially any appropriate "dual flow" rotating joint providing both supply and return fluid flow connections may be adapted for use as the rotating joint 32, a ROTARY UNION brand rotating joint of the types manufactured by Duff Norton Company of Charlotte, North Carolina, being preferred. The rotary joint 32 basically includes a hollow housing 34 adapted to be fixedly mounted stationarily adjacent the axially outwardly projecting end of the trunnion 16. A tubular shaft 36 rotatably supported sealably within the housing 34 extends outwardly therefrom and is attached by a flange 38 fitted about its projecting end to the mounting flange 25 of the support tube member 22 at the outward end of the trunnion 16 for unitary rotation therewith. A steam inlet port 40 is formed through the housing 34 in communication with the housing interior and with the interior of the tubular shaft 36 for admitting steam therethrough into the interior of the support tube member 22 to flow into the interior of the dryer drum apparatus 10 through the holes 28 of the support tube member 22. The rotating shaft 36 and the housing 34 are adapted to receive the siphon pipe 30 for extension entirely therethrough into sealed engagement with a condensate exhaust fitting 42 at the opposite outward side of the housing 34, the fitting 42 being adapted for connection with a suitable suction force for siphoning withdrawal of condensate forming within the dryer drum 10 through the siphon tube member 26, the elbow member 24 and the siphon pipe 30.

Figure 2:
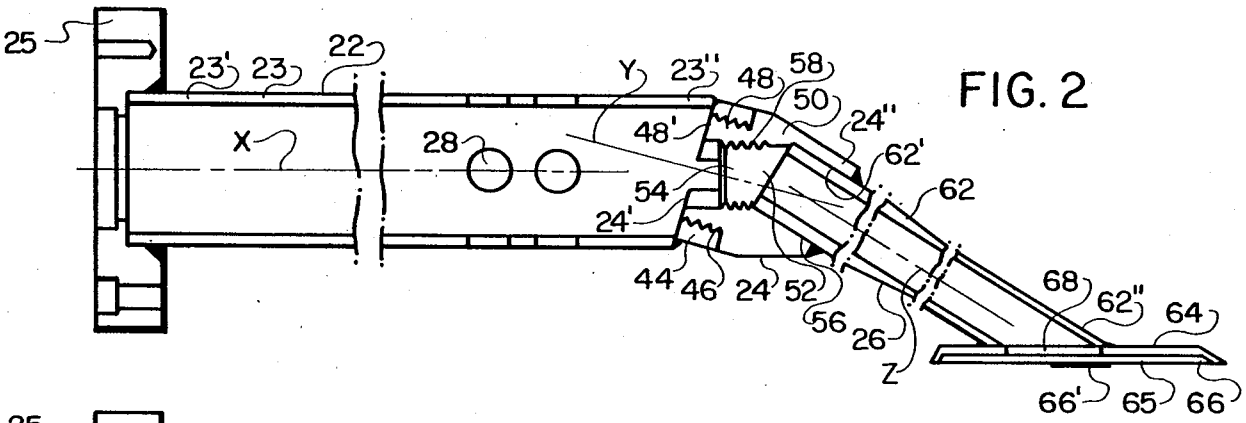
FIG. 2 is a vertical cross-sectional view of the components of the siphon tube assembly of FIG. 1.
Figure 3:
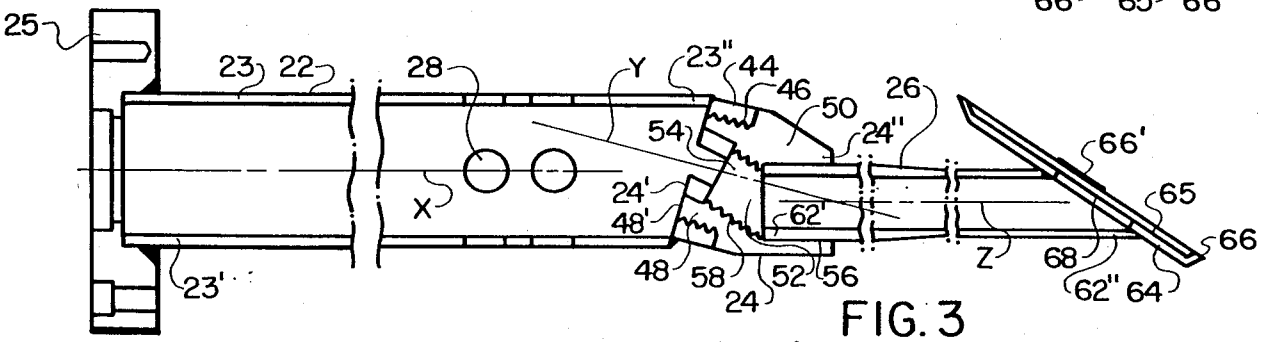
FIG. 3 is another vertical cross-sectional view of the components of the siphon tube assembly of FIG. 1 in a generally aligned disposition thereof to facilitate installation.

According to the present invention, the elbow joint provided between the support tube member 22, the elbow member 24 and the siphon tube member 26 uniquely enables the entire siphon tube assembly 20 to be articulated by relative rotation between the support tube member 22 and the elbow member 24 between a generally aligned disposition of the support and siphon tube members 22,26 shown in FIG. 3 facilitating installation of the siphon tube assembly 20 through the axial opening 16′ of the trunnion 16 and the operative disposition of the support and siphon tube members 22,26 shown in FIGS. 1 and 2 wherein they are angularly related with respect to one another.

As shown in FIGS. 2 and 3, the inwardly-projecting elbow connection end 23″ of the support tube 23 is formed angularly with respect to the central axis thereof to have a slightly elliptical shape to which a cylindrical nut member 44 is welded thereby orienting the axis of the nut member 44 in angular relation, preferably at approximately 16 degrees, to the axis of the support tube 23. The nut member 44 is provided with interiorly formed threads 46 for rotational connection with the elbow member 24 as will be presently described.

The elbow member 24 is of a tubular configuration having an exteriorly-threaded, substantially cylindrical connecting portion 48 at one axial end 24′ adapted for threaded rotational engagement within the nut member 44 and having a generally truncated conically-shaped main body 50 extending from the connecting portion 48 at an inward taper to the opposite end 24″ of the elbow member 24. A longitudinal bore or passageway 52 extends the length of the elbow member 24, formed by a first passageway bore 54 formed through the connecting portion 48 into the main body 50 and an intersecting bore 56 formed in the opposite end of the main body 50 to intersect in angular relation to the bore 54.

Figure 4:
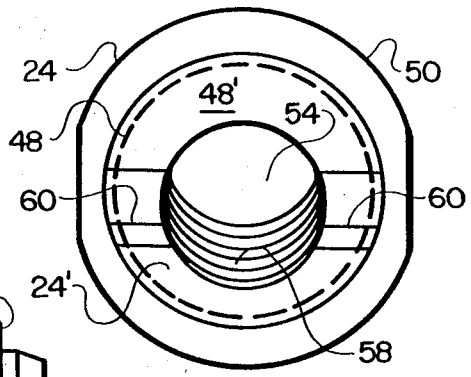
FIG. 4 is an end elevational view of the elbow member of the present siphon tube assembly.

The axis of the bore 54 is formed through the elbow member 24 in angular relation to the rotational axis of the cylindrical periphery of the threaded connection portion 48 at substantially the same angle as between the axes of the nut member 44 and the support tube 23 so as to be in coaxial alignment with the support tube 23 when the support tube member 22 and the elbow member 24 are oriented in their desired operative disposition, as shown in FIG. 2. The axially outward end of the bore 54 within the connecting portion 48 is slightly enlarged in relation to the remainder of the bore 54, the adjacent reduced-diameter section of the bore 54 being threaded at 58 for receiving the projecting threaded end of the siphon pipe 30. As seen in FIG. 4, the end face 48' of the threaded connection portion 48 has a pair of slots 60 formed therein in axial relation to the bore 54 at diametrically opposite sides thereof, the slots 60 forming a keyway facing and accessible through the interior of the support tube member 22 in its assembled relation with the elbow member 24 to facilitate selective rotation of the elbow member 24 with respect to the support tube member 22 utilizing the tool of FIGS. 6 and 7 as hereinafter more fully explained. The bore 56 is of a diameter compatible with the exterior diameter of the mating end of the siphon tube member 26 for snugly receiving it within the bore 56. The axis of the bore 56 is also formed in angular relation to the rotational axis of the cylindrical periphery of the threaded connection portion 48 at substantially the same angle as between the axis of the nut member 44 and the support tube 23 (but reversed from the bore 54) for enabling parallel orientation of the bore 56 and the siphon tube member 26 with respect to the support tube 23 when the support and siphon tube members are in their generally aligned disposition of FIG. 3.

Figure 5:
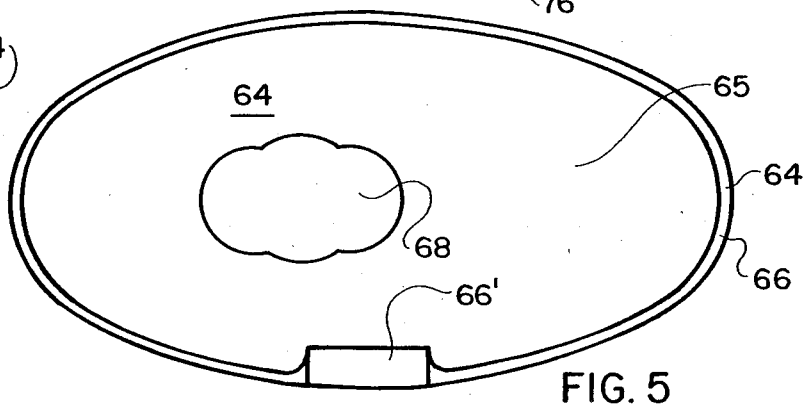
FIG. 5 is a bottom plan view of the suction foot of the siphon leg of the present siphon tube assembly.

The siphon tube member 26 includes an elongate tubular siphon leg 62 a mounting end 62' of which is of a relatively thick-walled construction rigidly fitted snugly within the bore 56 of the elbow member 24 and welded in place about the corresponding connection end of the elbow member 24. The opposite projecting end 62'' of the siphon leg 62 is formed at a relatively acute angle with respect to the longitudinal axis of the siphon leg 62 presenting an elliptical end face to which an oval-shaped suction foot 64 is welded in angular relation to the longitudinal axis of the siphon leg 62. As seen in FIG. 5, the suction foot 64 includes an annular wall 66 projecting from its outward face away from the siphon leg 62 forming a recessed siphon area 65 within the annular wall 66 which communicates with the interior of the siphon leg 62 through an opening 68 formed centrally through the suction foot 64. The annular wall 66 is formed with an enlarged support portion 66' at one lateral side of the suction foot 64 adapted for engagement with the interior drying wall 12' of the cylindrical shell 12 in the operative disposition of the siphon tube assembly 20 to maintain the suction foot 64 at a slight spacing from the interior wall 12' to facilitate siphoning of condensing steam therefrom.

As will thus be understood by a comparison of FIGS. 2 and 3, the elbow joint thusly formed between the support tube member 22, the elbow member 24, and the siphon tube member 26 provides the siphon tube assembly 20 with three different axes: (a) the longitudinal axis of the support tube 23, indicated at X in FIGS. 2 and 3; (b) the rotational axis of the elbow member 24 within the nut member 44 indicated at Y in FIGS. 2 and 3; and (c) the longitudinal axis of the siphon leg 62 indicated at Z in FIGS. 2 and 3. The axes X and Y are constantly maintained in a fixed angular relation with respect to one another determined by the angular relation between the nut member 44 and the support tube 23, regardless of the rotational disposition of the elbow member 24 within the nut member 44. Similarly, the axes Y and Z are constantly maintained in a fixed angular relation at the same angle with respect to one another determined by the angular relation between the threaded connection portion 48 and the bore 56 of the elbow member 24, again regardless of the rotational disposition of the elbow member 24 within the nut member 44. However, as will be understood, the angular relation between the axes X and Z changes in direct relation to the rotational disposition of the elbow member 24 within the nut member 44, as will be recognized by a comparison of FIGS. 2 and 3. The substantially identical angular relationships between the axes X and Y and the axes Y and Z, respectively, are selected according to the present invention to permit the axis X of the support tube 23 and the axis Z of the siphon leg 62 to move between an axially parallel relationship wherein the support tube 23 and the siphon leg 62 are in general alignment with one another, as depicted in FIG. 3, and a desired angular relationship to orient the suction foot 64 of the siphon tube member 26 in engagement with the interior wall 12' of the dryer drum apparatus 10 when the support tube member 22 is oriented coaxially with the trunnion 16, as depicted in FIG. 2. As will be understood, movement of the support and siphon tube members 22,26 between such relative dispositions must, of necessity, occur within one-half turn of the elbow member 24 within the nut member 44.

Additionally, according to the present invention, the several components of the siphon tube assembly 20 are configured and dimensioned cooperatively such that the siphon tube assembly 20 in its generally aligned disposition of FIG. 3 is of an overall dimension taken diametrically transverse with respect to the support tube 23 which dimension is less than the diameter of the axial opening 16' through the trunnion 16 along any increment of the length of the support tube assembly 20 to be inserted through the axial opening 16' (excluding of course the mounting flange 25 of the support tube member 22) which increment is equal to our less than the length of the reduced diameter entrance section 116' of the axial opening 16'. More particularly, the outer diameter of the support tube 23 is less than the diameter of the axial opening 16' through the trunnion 16. The nut member 44 is of a reduced outer diameter with respect to the support tube 23 and the length and angular relation of the nut member 44 with respect to the support tube 23 are selected so that the overall dimension of the nut member 44 taken diametrically transverse with respect to the support tube 23 is no greater than the outer diameter of the support tube 23. Similarly, the overall transverse dimension of the elbow member 24, is slightly less than that of the support tube 23 which, in conjunction with the threaded connection of the connecting portion 48 of the elbow member 24 interiorly within the nut member 44 and the tapered configuration of the main body 50 of the elbow member 24, is effective to only slightly increase the overall combined transverse dimension of the support tube 23, the nut member 44, and the elbow member 24 in the generally aligned disposition of FIG. 3 over the outer diametric dimension of the support tube 23. The siphon leg 62 is of an outer diametric dimension substantially smaller than that of either the support tube 23 or the elbow member 24 and the suction foot 64 is affixed to the siphon leg 62 at a sufficient angle with respect thereto so that the siphon tube member 26 also has an overall dimension taken diametrically transverse with respect to the support tube 23 to be no greater than the diameter of the support tube 23 in the disposition of the siphon tube assembly 20 shown in FIG. 3. Notably, also, the increasing stepped diameter of the axial opening 16' of the trunnion 16 results in the reduced diameter entrance section 116' having a relatively short axial length which is considerably less than the overall length of the siphon tube member 26 between the suction foot 64 thereof and the elbow member 24 so that any increase in the overall transverse dimension of the siphon tube assembly 20 attributable to the suction foot 64 poses no impediment to insertion of the siphon tube assembly 20 through the trunnion 16.

Figure 6:
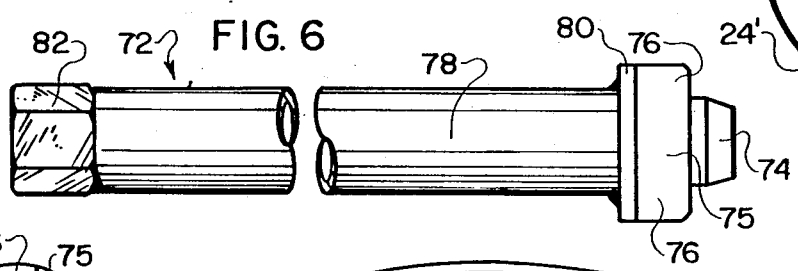
FIG. 6 is a side elevational view of a positioning tool compatible with the elbow member for selective rotation thereof.
Figure 7:
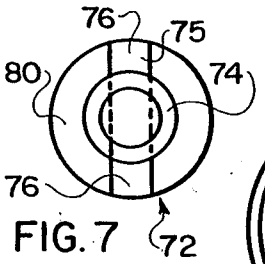
FIG. 7 is an end elevational view of the positioning tool of FIG. 6.

As previously mentioned, the slots 60 formed in the connecting portion 48 of the elbow member 24 provide a keyway accessible through the support tube member 22 to permit selective rotation of the elbow and siphon tube members 24,26 unitarily with respect to the support tube member 22 and its nut member 44, thereby enabling the selective orientation of the siphon tube assembly 20 between its dispositions of FIGS. 2 and 3 after its installation in the dryer drum apparatus 10 without the need for any handholes or manholes. For this purpose, a positioning tool indicated generally at 72 in FIGS. 6 and 7 is provided for use in installation of the siphon tube assembly 20, as hereinafter more fully explained. The positioning tool 72 includes an elongate shaft 78 of a length somewhat greater than the support tube member 22, with an operating head 80 fixed to one end of the shaft 78 and a driving head 82 fixed to the opposite end of the shaft 78. The operating head 80 includes a pilot tip 74 configured for insertion into the bore 54 of the elbow member 24 and a diametrically-arranged flange 75 positioned behind the pilot tip 74 to provide a pair of flange tips 76 extending laterally outwardly beyond the pilot tip 74 at opposite sides thereof to be adapted for insertion into the slots 60 in the elbow member 24. The hexagonal driving head 82 is adapted to be gripped and operated by a torque-wrench or other suitable tool which facilitates the exertion of a controlled amount of torsional force through the tool 72 to the elbow and siphon members 24,26.

For insertion of the siphon tube assembly 20 into and assembly with the dryer drum apparatus 10, the siphon tube assembly 20 is initially oriented by relative rotation of the elbow and siphon tube members 24,26 relative to the nut member 44 of the support tube member 22 into the operative angular disposition of FIG. 2 to permit an initial checking of the overall transverse dimension of the siphon tube assembly 20 diametrically with respect to the support tube 23 to confirm that such dimension corresponds with the portion of the interior diametric dimension of the cylindrical shell 12 of the dryer drum 10 to be occupied by the siphon tube assembly 20. Once this dimension has been properly confirmed, the orientation of the slots 60 of the elbow member 24 are visually inspected through the support tube 23 and corresponding reference marks are made on the end face of the mounting flange 25 of the support tube member 22. Next, the siphon pipe 30 is inserted through the support tube member 22 and threadedly tightened into the bore 54 of the elbow member 24 in order to check proper concentricity between the siphon pipe 30 and the support tube 23. The siphon pipe 30 is then removed and the elbow and siphon tube members 24,26 are unitarily rotated one-half turn about the nut member 44 to orient the siphon tube assembly 20 in its installation disposition shown in FIG. 3, following which the siphon tube assembly 20 is inserted through the axial opening 16' in the trunnion 16 until the mounting flange 25 of the support tube member 22 is in abutment with the outward axial end face of the trunnion 16. The flange support bolts 27 are inserted through the mounting flange 25 into the trunnion 16 sufficiently, but without complete tightening thereof in order to properly support the siphon tube assembly 20 concentrically with respect to the trunnion 16. Next, the operating end of the positioning tool 72 is inserted through the support tube member 22 and is manipulated to position its pilot tip 74 within the bore 54 and its lateral flange tips 76 in the slots 60 of the elbow member 24, following which the tool 72 is rotated to correspondingly turn the elbow and siphon tube members 24,26 unitarily one-half turn to reorient the siphon tube assembly 20 into its angular operating disposition of FIG. 2. The tool 72 is removed and a visual comparison is made of the orientation of the slots 60 of the elbow member 24 with the previous reference marks made on the mounting flange 25 of the support tube member 22 to confirm the proper angular orientation of the siphon tube assembly 20. The installation is completed by reinserting the siphon pipe 30 through the support tube member 22 into threaded engagement in the bore 54 of the elbow member 24, tightening of the flange bolts 27, and installation of the rotary joint 32.

As will thus be understood, this manner of installation of the siphon tube assembly 20 within the dryer drum apparatus 10 effectively orients the siphon tube member 22 in coaxial relation within the trunnion 16 while bracing the siphon tube member 26 in substantially rigid fixed engagement with the interior wall 12' of the cylindrical shell 12 for substantially integral rotation of the siphon tube assembly 20 with the dryer drum apparatus 10 for use of the siphon tube assembly 20 as a rotary siphon. The projecting dimension of the enlargement 70 on the annular wall 66 of the suction foot 64 maintains the foot 64 at slight spacing from the interior wall 12' to allow condensing moisture within the drum 10 which centrifugally collects on the wall 12' to enter the recessed area 65 within the annular wall 66 for siphoned exhaustion through the siphon leg 62, the elbow member 24, and the siphon pipe 30. To prevent any undesired loosening of the threaded connection between the elbow member 24 and the nut member 44, the mating threads thereon are selected to be of a hand counter to the direction of operating rotation of the dryer drum apparatus 10, whereby the rotational operation of the dryer drum apparatus 10 effectively serves to constantly apply a tightening force to the threaded connection. Of course, as those persons skilled in the art will readily recognize, the elbow joint of the present invention may be equally well embodied in a siphon tube assembly intended for use as a stationary siphon, the only differences over the construction of the siphon tube assembly 20 hereinabove described and illustrated being that the siphon tube assembly 26 would have an installed radial dimension with respect to the dryer drum apparatus 10 to be closely spaced to, but out of direct contact with, the interior drying wall 12' of the dryer drum apparatus 10 and, as is apparent, the stationary siphon tube assembly 20 would not be directly affixed to the trunnion 16 nor would it require the use of a rotary joint 32.

It will thus be understood that the elbow joint of the present invention uniquely provides a means by which a siphon tube assembly for a papermaking dryer drum apparatus may be selectively articulated for installation through the trunnion or other rotary journal of the dryer drum apparatus without requiring the provision of any handholes or manholes in the dryer drum apparatus. Importantly, the elbow joint provides a rotary threaded connection which effectively enables the present siphon tube assembly, as above described, to be tightened into rigid braced engagement with, and to prevent disengagement from, the interior peripheral drying wall of the dryer drum apparatus, in substantial contrast and overcoming the various problems of prior articulable siphon tube assemblies utilizing some form of pivot joint as its means of articulation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

That which is claimed is:

1. An articulable siphon tube assembly for use in a hollow rotary dryer drum having a tubular journal with an axial opening therethrough, said siphon tube assembly being particularly adapted for selective articulation for insertion into and removal from said drum through said axial opening of said journal and for siphoning disposition within said drum at a peripheral drying wall thereof, said siphon tube assembly comprising:

support tube means for operative positioning within said axial opening of said journal of said drum;

siphon tube means for operative positioning within said drum at said peripheral wall thereof; and tubular elbow means disposed intermediate and connected with said support tube means and said siphon tube means in respective end-to-end communication, said elbow means being rotatably connected to one of said support tube means and said siphon tube means for rotation annularly with respect thereto about an axis angularly oriented with respect to both thereof and being fixed to the other thereof for selective rotation of said elbow means and said other tube means to orient said support tube means and said siphon tube means either in general alignment with one another for permitting insertion and removal of said siphon tube assembly through said axial opening in said journal or at sufficient angular relation to one another for permitting mounting of said support tube means coaxially within said axial opening of said journal with said siphon tube means disposed at said peripheral drum wall for siphoning operation of said siphon tube assembly within said drum.

2. An articulable siphon tube assembly according to claim 1 and characterized further in that said elbow means is fixed rigidly to said siphon tube means and is rotatably connected to said support tube means.

3. An articulable siphon tube assembly according to claim 1 and characterized further in that said elbow means includes interior keyway means accessible through said support tube means for rotating said elbow means to control articulation of said support tube assembly from the exterior of said drum.

4. An articulable siphon tube assembly according to claim 2 and characterized further in that said elbow means includes interior keyway means accessible through said support tube means for rotating said elbow means to control articulation of said support tube assembly from the exterior of said drum.

5. An articulable siphon tube assembly according to claim 1 and characterized further in that said elbow means and said siphon tube means are cooperatively arranged for disposition of said siphon tube means braced rigidly in engagement with said peripheral drum wall in said angular relation of said support tube means and said siphon tube means for rotation of said siphon tube assembly with said drum.

6. An articulable siphon tube assembly according to claim 5 and characterized further in that said elbow means and said one tube means have mating respective threads for rotational connection thereof, said respective threads being of a hand counter to the direction of rotation of said dryer drum to resist relative rotation between said respective threads and to maintain said siphon tube means in braced engagement with said drum during its rotational operation.

7. An articulable siphon tube assembly according to claim 1 and characterized further in that said elbow means and said siphon tube means are cooperatively arranged for disposition of said siphon tube means at a spacing from said peripheral drum wall in said angular relation of said support tube means and said siphon tube means for stationary disposition of said siphon tube assembly during rotation of said drum.

8. An articulable siphon tube assembly according to claim 1 and characterized further in that said one of said support tube means and said siphon tube means includes nut means rigidly fixed to the connection end thereof about an axis angularly related to the axis of said one tube means, said elbow means includes a first connection end for rotational connection with said nut means and a second connection end for fixed connection rigidly with said other of said support tube means and said siphon tube means with its axis angularly related to the rotational axis of said nut means and elbow means.

9. An articulable siphon tube assembly according to claim 8 and characterized further in that said one tube means is said support means and said other tube means in said siphon tube means.

10. An articulable siphon tube assembly according to claim 9 and characterized further in that said first connection end of said elbow means has keyway means facing the interior of said support tube means for access therethrough to said keyway means for rotating said elbow means and said siphon tube means to control articulation of said support tube assembly from the exterior of said drum.

11. An articulable siphon tube assembly according to claim 9 and characterized further in that said elbow means includes an angled bore therethrough between said first and second connection ends, said bore at said first connection end being angularly related with the rotational axis between said first connection end and said nut means to be oriented coaxially with said support tube means in said angular relation between said support tube means and said siphon tube means.

12. An articulable siphon tube assembly according to claim 8 and characterized further in that said support tube means, its said nut means, said elbow means and said siphon tube means are cooperatively configured and dimensioned such that said support tube assembly is of an overall transverse dimension in the generally aligned diposition of said support tube means and said siphon tube means less than the transverse dimension of said axial opening through said journal along any increment of the length of said support tube assembly to be inserted through said axial opening which increment is equal to or less than the length of said axial opening.

13. An articulable siphon tube assembly according to claim 12 and characterized further in that the journal-inserted portion of said support tube means and said elbow means are of a combined overall dimension transversely with respect to the length of said support tube means less than the transverse dimension of said axial opening through said journal and said siphon tube means includes a suction foot mounted at its extending end angularly with respect to the length thereof such that said siphon tube means in its said generally aligned disposition with said support tube means has an overall dimension transversely with respect to the length of said support tube means less than the transverse dimension of said axial opening.

14. An articulable siphon tube assembly for rotary use in a hollow rotary dryer drum of the type adapted for continuously drying a traveling paper web in a papermaking operation, said drum having a tubular support journal with an axial opening therethrough, said siphon tube assembly being particularly adapted for selective articulation for insertion into and removal from said dryer through said axial opening of said journal and for siphoning disposition within said drum in rigid engagement with said journal and with a peripheral drying wall thereof, said siphon tube assembly comprising:

support tube means for operative positioning within said axial opening of said journal of said drum, said support tube means including a linear support tube, a mounting flange rigidly fixed at a mounting end of said support tube adapted to be affixed to said journal with said support tube extending coaxially therethrough and threaded nut means rigidly fixed at an opposite connection end of said support tube about an axis angularly oriented to the axis of said support tube;

siphon tube means for operative positioning within said drum in rigid engagement with said peripheral wall thereof, said siphon tube means including a linear siphon tube having a connection end and a siphon foot at an opposite siphon end;

tubular elbow means disposed intermediate and connected with the respective connection ends of said support tube and said siphon tube in end-to-end communication, said elbow means having a first threaded connection end adapted for rotational connection with said nut means and a second connection end for rigid fixed connection with said connection end of said siphon tube;

said nut means and said elbow means being cooperatively arranged for selective relative rotation between an installation orientation wherein said support tube and said siphon tube are in general alignment with one another for permitting insertion and removal of said siphon tube assembly through said axial opening in said journal, said support tube, its said nut means, said siphon tube means and said elbow means being cooperatively configured and dimensioned such that said support tube assembly in its installation orientation is of an overall transverse dimension less than said axial opening through said journal along any increment of the length of said support tube assembly to be inserted through said axial opening which increment is equal to or less than the length of said axial opening, and an operative orientation wherein said support tube and said siphon tube are at sufficient angular relation to one another for permitting affixation of said flange of said support tube means coaxially to said journal with said support tube extending coaxially therethrough and with said siphon foot of said siphon tube means braced rigidly in engagement with said peripheral drum wall for siphoning operation within said drum in unitary rotation with siphon tube assembly; and said first connection means of said elbow means having keyway means facing the interior of said support tube for access therethrough to said keyway means for unitarily rotating said elbow means and said siphon tube means to control articulation of said support tube assembly from the exterior thereof.

15. An articulable siphon tube assembly according to claim 14 and characterized further in that said nut means and said first threaded connection end of said elbow means having mating respective threads of a hand counter to the direction of rotation of said dryer drum to resist relative rotation between said respective threads and to maintain said siphon tube means in braced engagement with said drum during its rotational operation.

16. An articulable siphon tube assembly according to claim 14 and characterized further in that said elbow means includes an angled bore therethrough between said first and second connection ends, said bore at said first connection end being angularly related with the rotational axis between said first connection end and said nut means to be oriented coaxially with said support tube means in said angular relation between said support tube means and said siphon tube means.

17. An articulable siphon tube assembly according to claim 14 and characterized further in that said support tube and said elbow means are of a combined overall dimension transversely with respect to the length of said support tube means less than the transverse dimension of said axial opening through said journal and said siphon foot of said siphon tube means is oriented angularly with respect to the length of said siphon tube such that said siphon tube means in said installation disposition has an overall dimension transversely with respect to the length of said support tube means less than the transverse dimension of said axial opening.

* * * * *